US008707742B2

(12) United States Patent
Kim et al.

(10) Patent No.: US 8,707,742 B2
(45) Date of Patent: Apr. 29, 2014

(54) LAUNDRY TREATMENT MACHINE AND CONTROL METHOD THEREOF

(75) Inventors: Youngjong Kim, Kyungsangnam-do (KR); Changwoo Son, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 521 days.

(21) Appl. No.: 12/846,890

(22) Filed: Jul. 30, 2010

(65) Prior Publication Data

US 2011/0016640 A1 Jan. 27, 2011

Related U.S. Application Data

(60) Provisional application No. 61/230,588, filed on Jul. 31, 2009, provisional application No. 61/230,519, filed on Jul. 31, 2009, provisional application No. 61/230,624, filed on Jul. 31, 2009, provisional application No. 61/230,568, filed on Jul. 31, 2009.

(30) Foreign Application Priority Data

| | | |
|---|---|---|
| Jul. 31, 2009 | (KR) | 10-2009-0071032 |
| Jul. 31, 2009 | (KR) | 10-2009-0071033 |
| Jul. 31, 2009 | (KR) | 10-2009-0071034 |
| Jul. 31, 2009 | (KR) | 10-2009-0071035 |
| Oct. 30, 2009 | (KR) | 10-2009-0104443 |
| Oct. 30, 2009 | (KR) | 10-2009-0104444 |
| Jul. 27, 2010 | (KR) | 10-2010-0072496 |

(51) Int. Cl.

| | |
|---|---|
| ***D06F 37/10*** | (2006.01) |
| ***D06F 37/18*** | (2006.01) |
| ***D06F 37/28*** | (2006.01) |
| ***D06F 37/42*** | (2006.01) |
| ***D06F 39/14*** | (2006.01) |
| *D06F 33/00* | (2006.01) |

(52) U.S. Cl.
CPC ..... *D06F 37/28* (2013.01); *D06F 37/42* (2013.01); *D06F 39/14* (2013.01); *D06F 2224/00* (2013.01)
USPC ..... 68/12.02; 8/158; 134/18

(58) Field of Classification Search
USPC ..... 8/158; 68/12.02; 134/18
See application file for complete search history.

(56) References Cited

U.S. PATENT DOCUMENTS

| | | | | |
|---|---|---|---|---|
| 3,627,960 | A | 12/1971 | Grabek | |
| 3,763,670 | A | 10/1973 | Harrold | |
| 4,623,179 | A * | 11/1986 | Davis et al. | 292/201 |
| 4,866,955 | A | 9/1989 | Blair et al. | |
| 2005/0120492 | A1 * | 6/2005 | Koo et al. | 8/159 |
| 2006/0288742 | A1 * | 12/2006 | Hapke et al. | 68/12.26 |
| 2007/0193310 | A1 * | 8/2007 | Penteado et al. | 68/12.04 |

FOREIGN PATENT DOCUMENTS

WO WO 2007/025203 A2 3/2007

* cited by examiner

*Primary Examiner* — Joseph L Perrin
*Assistant Examiner* — Levon J Shahinian
(74) *Attorney, Agent, or Firm* — Birch, Stewart, Kolasch & Birch, LLP

(57) ABSTRACT

A laundry treatment machine includes a device driving unit configured to control a lock device including a lock element, and a lead, which moves along with the lock element. If the lock element is moved to a lock position, a device controller determines whether the lead is moved from its initial position to a predetermined position and outputs a first detection signal as the result of the determination. The device controller outputs lock information if the first detection signal is received, and determines that the lid assembly and the top cover are not locked and outputs lock error information if the first detection signal is not received. Therefore, it is possible to easily determine whether laundry is stuck between the lid assembly and the top cover and whether the motor is broken by locking or unlocking the lid assembly and the top cover with the use of the lock element.

9 Claims, 16 Drawing Sheets

LAUNDRY TREATMENT MACHINE AND CONTROL METHOD THEREOF

CROSS-REFERENCE TO RELATED APPLICATION

This application claims priority from Korean Patent Application No. 10-2009-0071032, Korean Patent Application No. 10-2009-0071033, Korean Patent Application No. 10-2009-0071034, Korean Patent Application No. 10-2009-0071035 filed on Jul. 31, 2009, Korean Patent Application No. 10-2009-0104443, Korean Patent Application No. 10-2009-0104444 filed on Oct. 30, 2009, Korean Patent Application No. 10-2010-0072496 filed on Jul. 27, 2010 in the Korean Intellectual Property Office, and U.S. Provisional Patent Application No. 61/230,588, 61/230,519, 61/230,624, 61/230,568 filed on Jul. 31, 2009 in the USPTO, the disclosure of which is incorporated herein by reference in its entirety.

BACKGROUND OF THE INVENTION

1. Field of the Invention

The present invention relates to a laundry treatment machine and a control method thereof, and more particularly, to a laundry treatment machine, which can drive a locking element when coupling a lid assembly and a top cover and then lock or unlock the lid assembly and the top cover with the aid of the lock element so as to determine whether laundry is stuck between the lid assembly and the top cover and can easily determine whether a motor that moves the locking element is broken, and a control method of the laundry treatment machine.

2. Description of the Related Art

Laundry treatment machines include various types of machines that can treat laundry by causing a physical and/or chemical reaction with laundry such as a washing machine for washing laundry by using a chemical reaction between water and detergent and the friction between water and laundry, a dryer for drying wet laundry, and a refresher capable of preventing allergies from laundry and facilitating the washing of laundry by spraying heated water vapor onto laundry.

Washing machines, which are a type of laundry treatment machine, are largely classified into an agitator-type washing machine, a drum-type washing machine and a pulsator-type washing machine. In general, washing machines wash laundry by sequentially performing a wash process, a rinse process and a spin-dry process. Washing machines may be configured to selectively perform only some of the wash process, the rinse process and the spin-dry process at users' choice and to choose an appropriate washing method for laundry.

SUMMARY OF THE INVENTION

The present invention provides a laundry treatment machine, which can drive a locking element when coupling a lid assembly and a top cover and then lock or unlock the lid assembly and the top cover with the aid of the lock element so as to determine whether laundry is stuck between the lid assembly and the top cover and can easily determine whether a motor that moves the locking element is broken, and a control method of the laundry treatment machine.

According to an aspect of the present invention, there is provided a laundry treatment machine including a top cover configured to have a laundry entrance hole through which laundry is put in or taken out of the laundry treatment machine; a lid assembly configured to be disposed above the top cover so as to be rotatable, the lid assembly opening or shutting the laundry entrance hole; a lock device configured to include a lock element and a lead, the lock element locking or unlocking the lid assembly and the top cover, and the lead moving in the same direction as the lock element; and a device driving unit configured to detect a position of the lead, determine an operating state of the lock device based on the detected position of the lead, and control an operation of the lock device, wherein, if the lock element is moved from its initial unlock position to a lock position where it can lock the lid assembly and the top cover, the device driving unit receives an initial detection signal, and if no detection signal is received within a first setting time of the receipt of the initial detection signal, the device driving unit determines that the lid assembly and the top cover are not properly locked, and outputs first error information.

According to another aspect of the present invention, there is provided a laundry treatment machine including a device driving unit configured to control a lock device including a lock element, which locks or unlocks a lid assembly and a top cover, and a lead, which moves along with the lock element, when the lid assembly and the top cover are coupled, wherein the device driving unit includes a position detector, which, if the lock element is moved from its initial unlock position to a lock position where it can lock the lid assembly and the top cover, determines whether the lead is moved from its initial position to a predetermined position and outputs a first detection signal as the result of the determination, and a device controller, which determines that the lid assembly and the top cover are locked and outputs lock information if the first detection signal is received, and which determines that the lid assembly and the top cover are not locked and outputs lock error information if the first detection signal is not received.

According to another aspect of the present invention, there is provided a control method of a laundry treatment machine, the control method including, if the lid assembly and the top cover are coupled, moving a lock element from its initial unlock position in response to an input command; detecting a position of the lock element; and generating lock information if the lock element is located at a lock position, and generating lock error information if the lock element is not located at the lock position.

According to another aspect of the present invention, there is provided a control method of a laundry treatment machine, the control method including, if a lid assembly and a top cover are coupled, driving a motor to move a lock element from its initial unlock position to a lock position in response to an input command; detecting a driving voltage supplied to the motor; and determining whether the motor is broken based on the detected driving voltage.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
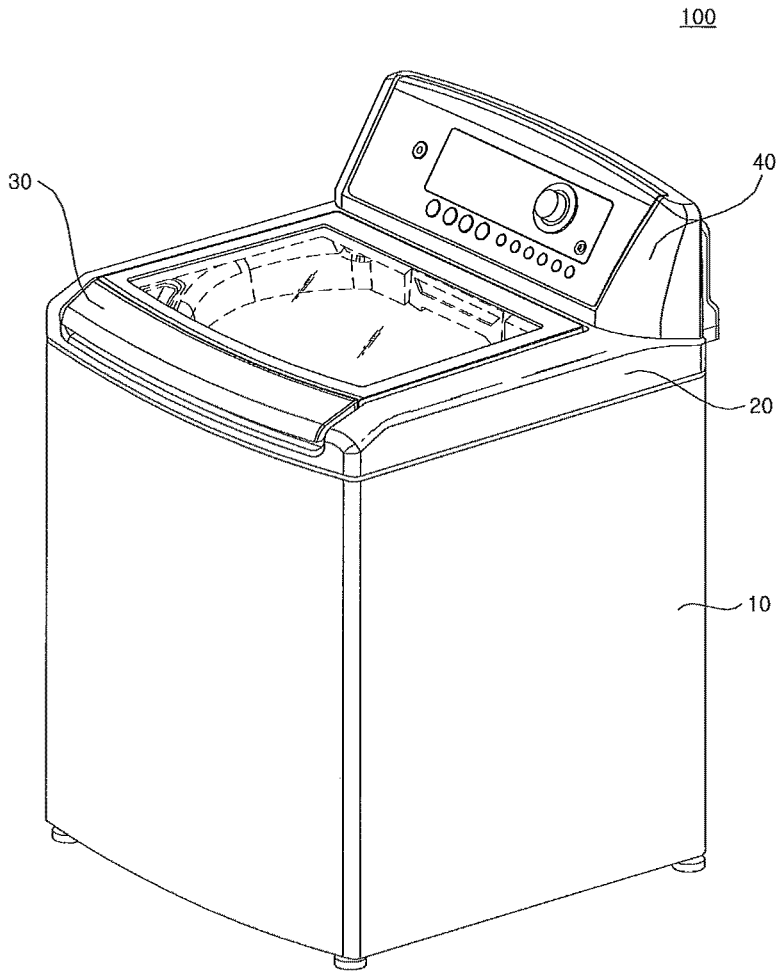
FIG. 1 illustrates a perspective view of a laundry treatment machine according to a first exemplary embodiment of the present invention.

The present invention will hereinafter be described in detail with reference to the accompanying drawings in which exemplary embodiments of the invention are shown. In the drawings, like reference numerals indicate like elements.

Figure 2:
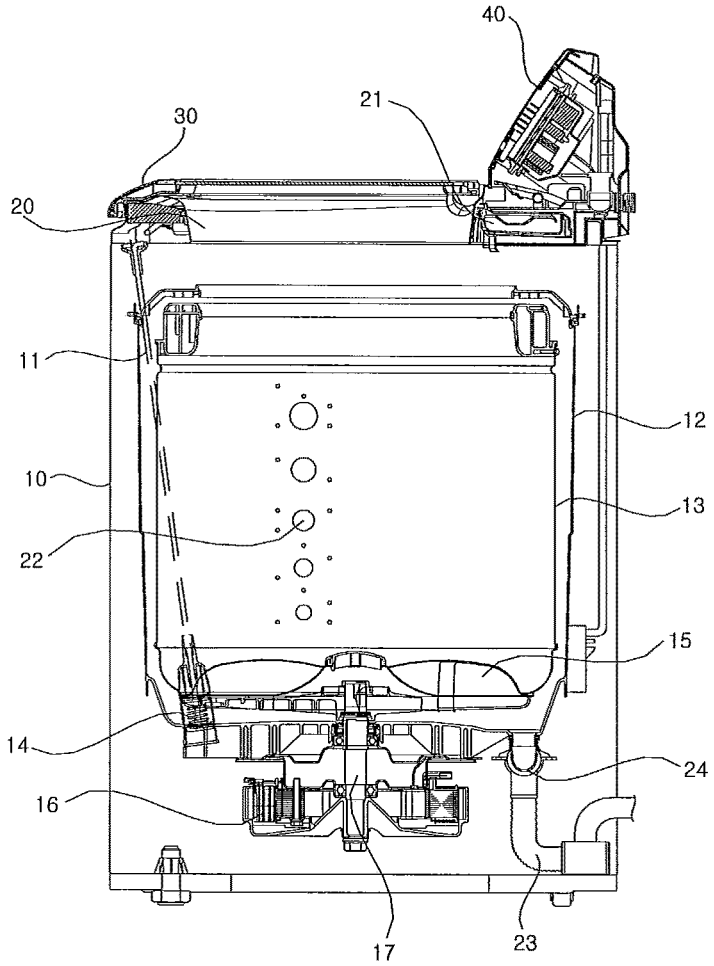
FIG. 2 illustrates a side cross-sectional view of the laundry treatment machine.
Figure 3:
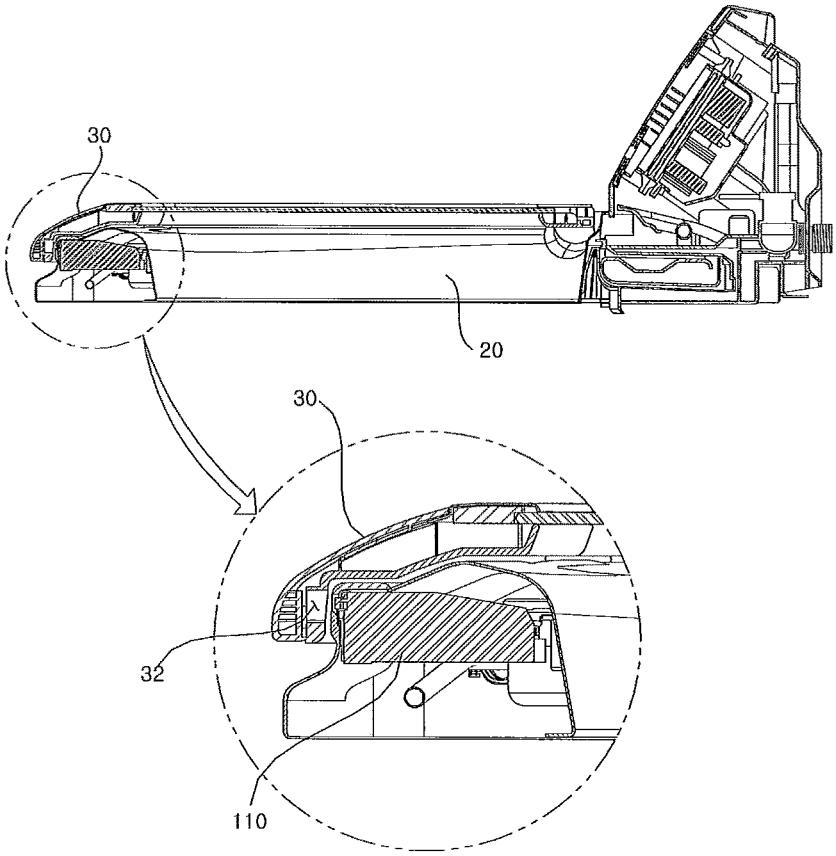
FIG. 3 illustrates detailed side-cross sectional views of a lid assembly and a top cover shown in FIG. 2.

FIG. 1 illustrates a perspective view of a laundry treatment machine 100 according to a first exemplary embodiment of the present invention, FIG. 2 illustrates a side cross-sectional view of the laundry treatment machine 100, and FIG. 3 illustrates detailed side-cross sectional views of a lid assembly 30 and a top cover 20 shown in FIG. 2. Referring to FIGS. 1 through 3, the laundry treatment machine 100 may include a cabinet 10, the top cover 20, which is placed on an upper end of the cabinet 10 and has a laundry entrance through which laundry can be put into or taken out of the laundry treatment machine 100, the lid assembly 30, which is disposed at the front of the top of the top cover 20 so as to be rotatable and to open or shut the laundry inlet/outlet hole, and a control panel 40, which is disposed at the rear of the top of the top cover 20 and provides an interface for manipulating the laundry treatment machine 100.

The laundry treatment machine 100 may also include an outer tub 12, which is disposed in the cabinet 10 and is suspended on a supporting element 11, and an inner tub 13, which is disposed in the outer tub 12 so as to be rotatable.

The laundry treatment machine 100 may also include a damper 14, which is disposed below the supporting element 11 and can reduce the fluctuation of the outer tub 12 when vibration is generated upon the rotation of the inner tub 13, and a pulsator 15, which is disposed at the bottom of the inner tub 13 and generates a rotating water current in the inner tub 13.

The laundry treatment machine 100 may also include a motor 16, which is disposed below the outer tub 12 and rotates the inner tub 13 and the pulsator 15. The motor 16 may be connected to the inner tub 13 via a rotation axial member 17 and may thus be able to rotate the inner tub 13. A clutch (not shown) may be disposed between the inner tub 13 and the pulsator 15. The clutch may selectively transmit the rotation force of the motor 16 to the inner tub 13 and the pulsator 15. Thus, only one of the inner tub 13 and the pulsator 15 may be rotated at a time by the motor 16, or the inner tub 13 and the pulsator 15 may both be rotated at the same time by the motor 16.

A detergent box 21, a water supply hose (not shown), and a water supply valve may be disposed in the top cover 20. The detergent box 21 may be installed so as to be able to be moved in and out of the top cover 20. The water supply hose may be connected to an external water source, and may thus be used to supply wash water into the detergent box 21. The water supply valve may control the supply of wash water through the water supply hose. When the water supply valve is opened, wash water from the external water source can be supplied into the detergent box 21 and then into the inner tub 13.

The wash water supplied into the inner tub 13 through the detergent box 21 may be contained in the outer tub 12, passing through a plurality of water holes formed in the inner tub 13, and laundry may be contained in the inner tub 13.

A drain hose 23 and a drain valve 24 may be disposed below the outer tub 12. The drain hose 23 may be used to discharge wash water from the outer tub 12. The drain valve 24 may be used to control the discharge of wash water through the drain hose 23.

A lock device 110 may be housed in the top cover 20. The lock device 110 may lock or unlock the lid assembly 30 when coupling the lid assembly 30 to the top cover 20.

More specifically, the lock device 110 may include a lock element (not shown) and may thus be able to lock or unlock the top cover 20 and the lid assembly 30 by moving the lock element.

Figure 4:
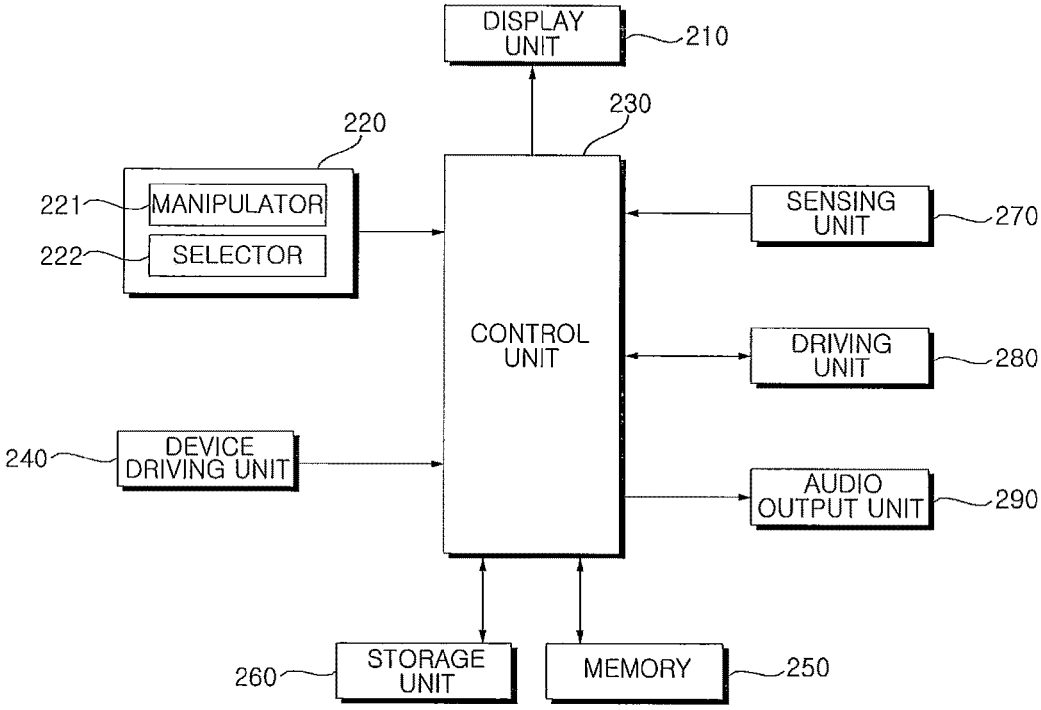
FIG. 4 illustrates a block diagram of the laundry treatment machine.

FIG. 4 illustrates a block diagram of the laundry treatment machine 100. Referring to FIG. 4, the laundry treatment machine 100 may include a display unit 210, an input unit 220, a device driving unit 240, a memory 250, a sensing unit 270, a driving unit 280, an audio output unit 290, and a control unit 230, which controls the general operation of the laundry treatment machine 100.

The input unit 220 may include at least one input tool for inputting signals or data to the laundry treatment machine in response to user manipulation thereof. More specifically, the input unit 220 may include a manipulator 221 and a selector 222.

The manipulator 221 may receive various data such as wash courses or wash settings and may transmit the received data to the control unit 230 during the course of the operation of the laundry treatment machine 100.

The input unit 220 may include, but is not restricted to buttons, a dome switch, a resistive or capacitive touch pad, a jog wheel, a jog switch, a finger mouse, a rotary switch, and/or a jog dial. That is, nearly all types of device that can generate predetermined input data by being appropriately manipulated (for example, by being pushed, rotated, pressed or touched) may be used as the input unit 220.

The sensing unit 270 may include at least one sensing tool for sensing temperature, pressure, a voltage, a current, a water level and the number of revolutions, and may transmit data obtained by the sensing to the control unit 230.

For example, the sensing unit 270 may measure the water level in the laundry treatment machine 100 during a water supply or drain operation, and may measure the temperature of water supplied into the laundry treatment machine 100 or the number of revolutions of a washing tub or a drum of the laundry treatment machine 100.

The driving unit 280 may control the laundry treatment machine 100 to perform a predefined operation in response to a control command applied thereto by the control unit 230. Therefore, the laundry treatment machine 100 can perform a series of processes such as washing, rinsing and spin-drying and can thus remove dirt from laundry.

For example, the driving unit 280 may drive the motor 16 to rotate a washing tub or drum of the laundry treatment machine 100 and may control the operation of the motor 16 so as for the laundry treatment machine 100 to effectively remove dirt from laundry. In addition, the driving unit 280 may control various valves in the laundry treatment machine 100 in response to a control command applied thereto by the control unit 230 so as for the laundry treatment machine 100 to effectively perform water supply and drain operations.

Examples of the memory 250 include, but are not restricted to a read-only memory and an electrically erasable programmable ROM (EEPROM) for storing control data regarding the laundry treatment machine 100, and a data storage means for storing data obtained by processing various operations performed by the laundry treatment machine 100. The storage unit 260 may be a buffer of the control unit 230, and may be used to store data temporarily. Examples of the storage unit 260 include, but are not restricted to a dynamic random access memory (DRAM) and a static random access memory (SRAM). The storage unit 260 may be incorporated into the control unit 230 or the memory 250.

The memory 250 may store operation information such as operating state data generated during a predetermined operation of the laundry treatment machine 100 and settings data input to the laundry treatment machine 100 via the manipulator 221 for driving the laundry treatment machine 100 to perform a predetermined operation; usage information such as the number of times the laundry treatment machine 100 has performed a predetermined operation and product specifications information of the laundry treatment machine 100; and failure information such as the cause and location of failure.

The memory 250 may store product information of the laundry treatment machine 100, including the operation information, the usage information and the failure information. The storage unit 260 may store temporary data corresponding to the operation information and the failure information. For example, the product information may include the number of times the laundry treatment machine 100 has been used, wash courses provided by the laundry treatment machine 100, option settings information, error code, sensor measurements, calculation data provided by the control unit 230, and operation information regarding each part of the laundry treatment machine 100.

The operation information may include various information necessary for driving the laundry treatment machine 100 such as wash operation information, spin-dry operation information and rinse operation information.

The failure information may include operation failure information regarding failure that may occur during the operation of the laundry treatment machine 100, defect information, error code, information provided by the control unit 230, measurement data provided by the sensing unit 270, measurement data obtained from the motor 16, failure information of a wash water supply device, and failure information of a drain device.

The usage information may include the number of times the laundry treatment machine 100 has been used, wash courses selected by a user, and option settings information regarding options set in the laundry treatment machine 100. That is, the usage information may include various data input to the laundry treatment machine 100 by a user and initial settings information of the laundry treatment machine 100.

The device driving unit 240 may operate in response to a control command applied thereto by the control unit 230. The device driving unit 240 may rotate a motor included in the lock device 110 in consideration of whether the lid assembly 30 and the top cover 20 are placed in contact with each other, and may thus move a lock element (not shown) so as to lock or unlock the lid assembly 30 and the top cover 20.

The control unit 230 may control the general operation of the laundry treatment machine 100. The control unit 230 may perform a wash operation (including washing, rinsing, and spin-drying) according to a wash mode set via the input unit 220 and a wash command issued by a user. The control unit 230 may determine the duration, speed and mode of driving of a driving device (not shown) based on various measurement data provided by the sensing unit 270 such as the level and temperature of water contained in a washing tub 122 or a drum (not shown) and the amount of laundry.

That is, the control unit 230 may appropriately control a wash operation set by a user with reference to sensing results provided by the sensing unit 270. In addition, the control unit 230 may control various valves provided in the laundry treatment machine 100 so as for the laundry treatment machine 100 to properly perform water supply and drain operations according to the progress in a whole wash process.

The display unit 210 may display various information input to the laundry treatment machine 100 via the selector 222 and the manipulator 221, operating state information of the laundry treatment machine 100, and status information of the laundry treatment machine 100 (such as information indicating whether the laundry treatment machine 100 has completed a predetermined operation) in response to a control signal applied thereto by the control unit 230. If the laundry treatment machine 100 malfunctions, the display unit 210 may display failure information indicating the malfunction of the laundry treatment machine 100.

Examples of the display unit 210 include a light-emitting diode (LED) display, a liquid crystal display (LCD) an organic electroluminescent display (OLED) and any other display that can visualize information by emitting light.

Figure 5:
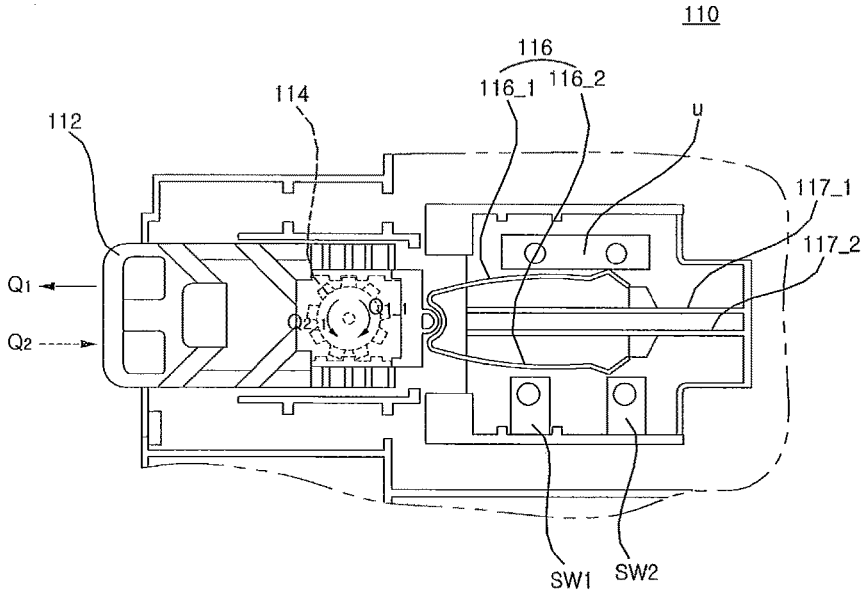
FIG. 5 illustrates a cross-sectional view of a lock device shown in FIG. 1.

FIG. 5 illustrates a cross-sectional view of the lock device 110. Referring to FIG. 5, the lock device 110 may include a lock element 112, a motor 114, a lead 116, a common contact U, an initial contact SW1 and a lock contact SW2.

The lock element 112 may be moved by the rotation of the motor 114.

More specifically, when the motor 114 rotates in a first rotation direction Q1_1, the lock element 114 may be moved to a first direction Q1, and may thus lock the top cover 20 and the lid assembly 30. On the other hand, when the motor 114 rotates in a second rotation direction Q2_1, the lock element 114 may be moved to a second direction Q2, and may thus unlock the top cover 20 and the lid assembly 30.

The motor 114 may be controlled by the device driving unit 240. When a first driving voltage is supplied, the motor 114 may rotate in the first rotation direction Q1_1. When a second driving voltage is supplied, the motor 114 may rotate in the second rotation direction Q2_1.

The lead 116 may be connected to the lead element 112. An upper portion 116_1 of the lead 116 may be placed in contact with the common contact U, and a lower portion 116_2 of the lead 116 may be placed in contact with at least one of the initial contact SW1 and the lock contact SW2 according to the position of the lock element 112. Lead bars 117_1 and 117_2 may be provided at the ends of the upper and lower portions 116_1 and 116_2, respectively, of the lead 116. When the lock element 112 is moved, the lead 116 may also be moved in the first or second direction Q1 and Q2 along the lead bars 117_1 and 117_2.

The lead 116 may be electrically connected to at least one of the common contact U, the initial contact SW1 and the lock contact SW2, and may thus transmit an initial sensing signal or another sensing signal to the device driving unit 240 in order to indicate whether the top cover 20 and the lid assembly 30 are locked or unlocked.

Figure 6:
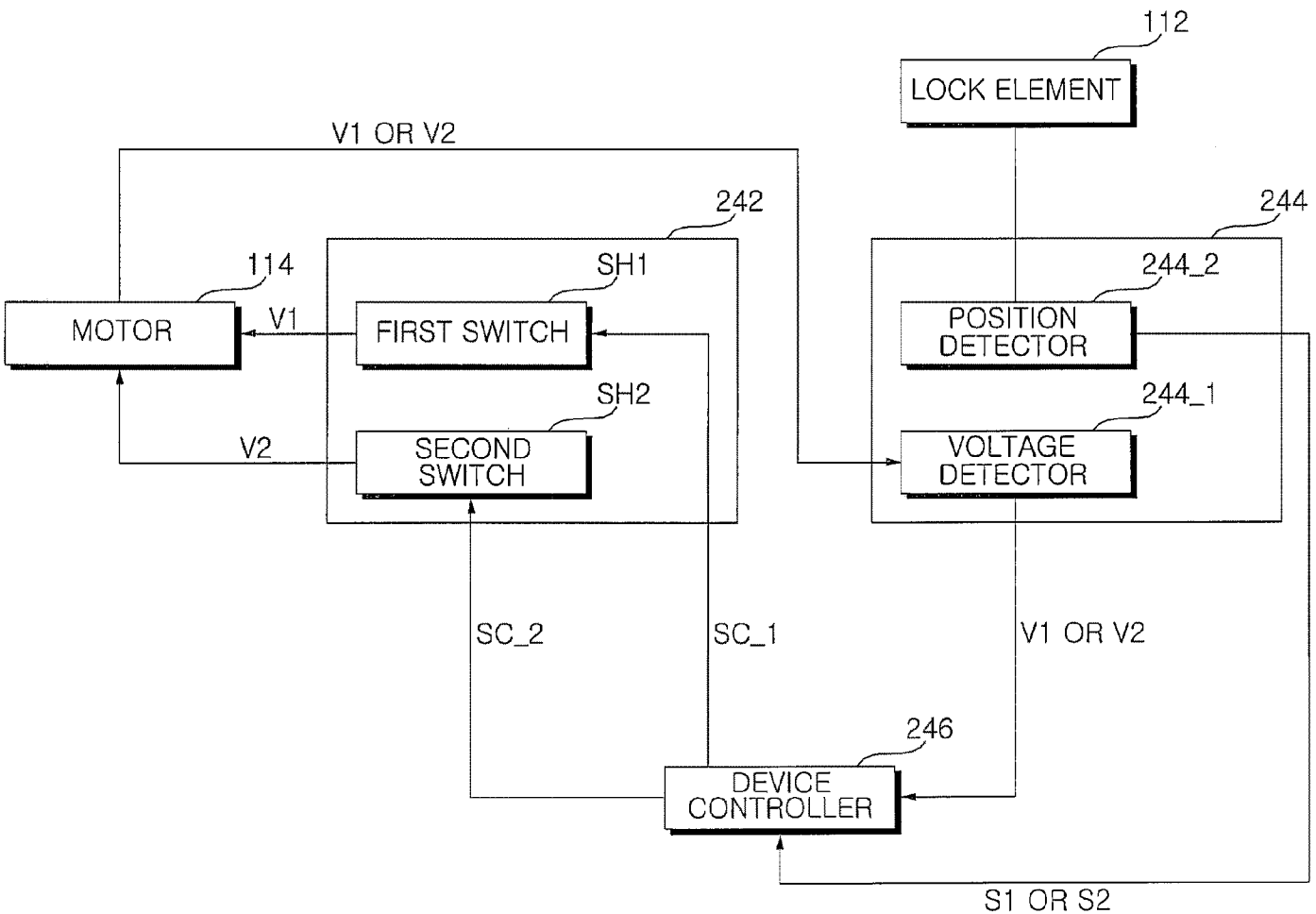
FIG. 6 illustrates a block diagram of a device driving unit shown in FIG. 4.
Figure 7:
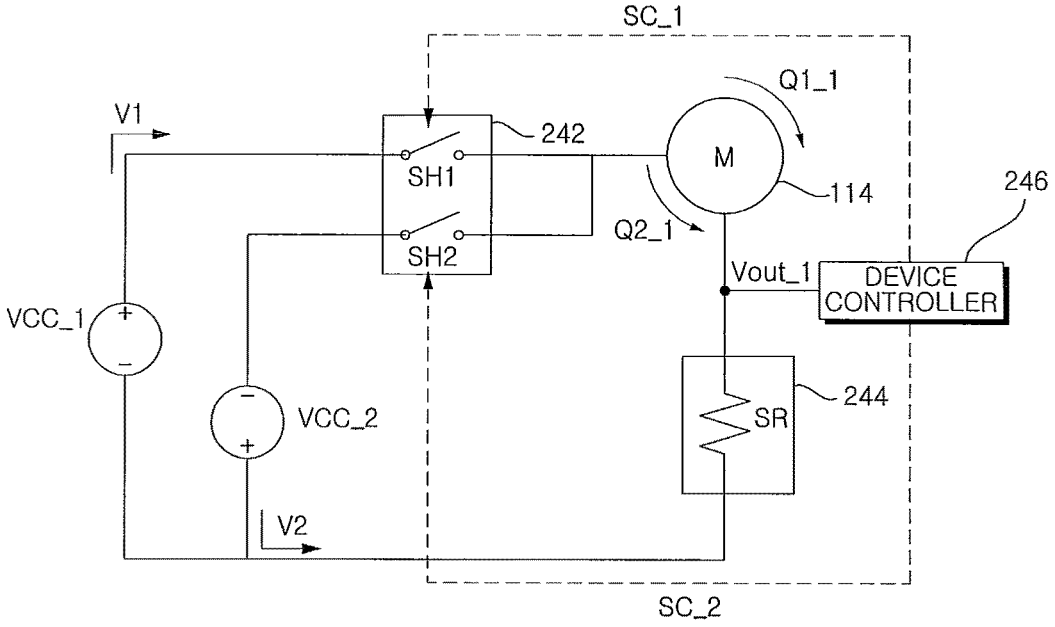
FIG. 7 illustrates a circuit diagram of a first embodiment of the device driving unit shown in FIG. 6.

FIG. 6 illustrates a block diagram of the device driving unit 240, and FIG. 7 illustrates a circuit diagram of a first embodiment of the device driving unit 240. Referring to FIGS. 6 and 7, the device driving unit 240 may include a motor driver 242, which rotates the motor 114 in the first or second rotation direction Q1_1 and Q2_1, a detector 244, which detects first and second driving voltages V1 and V2 supplied to the motor 114 and the position of the lock element 112, and a device controller 246, which determines whether the motor 114 is broken and whether the lid assembly 30 and the top cover are locked or unlocked based on the position of the lock element 112 and at least one of the first and second driving voltages V1 and V2 detected by the detector 244 and thus controls the motor driver 242 based on the results of the determination.

The motor driver 242 may include first and second switches SH1 and SH2, which are switched on or off under the control of the device controller 246 so as to supply the first and second driving voltages V1 and V2 to the motor 114.

The first and second switches SH1 and SH2 may be alternately switched on or off by the device controller 246. The first switch SH1 may be connected between a first power source VCC_1, which supplies the first driving voltage V1, and the motor 114. The second switch SH2 may be connected between a second power source VCC_2, which supplies the second driving voltage V2, and the motor 114.

The first and second power sources VCC_1 and VCC_2 are illustrated as being separate elements, but the present invention is not restricted to this. That is, the first and second power sources VCC_1 and VCC_2 may be incorporated into a single power source with opposite polarities.

The first and second switches SH1 and SH2 may be switched on or off in response to first and second control signals SC_1 and SC_2 generated by the device controller 246.

For example, if the first control signal SC_1 is applied, the first switch SH1 may be switched on in response to the first control signal SC_1. Then, the second control signal SC_2 may be applied, and thus, the second switch SH2 may be switched off in response to the second control signal SC_2.

The detector 244 may include a voltage detector 244_1, which detects one of the first and second driving voltages V1 and V2 that are supplied to the motor 114 by the device controller 246, and a position detector 244_2, which detects the position of the lead 116 that moves along with the lock element 114 during the movement of the lock element 114 in the first or second direction Q1 or Q2.

The voltage detector 244_1 may include a shunt resistor SR which detects one of the first and second driving voltages V1 and V2.

The shunt resistor SR may be connected to one side of the motor 114, may detect one of the first and second driving voltages V1 and V2, and may supply the detected driving voltage to the device controller 246.

The position detector 244_2 may detect the position of the lead 116, which moves along with the lock element 112 when the lock element 112 moves in the first or second direction Q1 and Q2.

When the lock element 112 is located at its initial position, the common contact U and the initial contact SW1 are electrically connected by the lead 116. In this case, the position detector 244_2 may transmit an initial detection signal 51 to the device controller 246.

Then, if the motor 114 rotates in the first rotation direction Q1_1 and thus the lock element 112 is moved in the first direction Q1 by the motor 114, the lead 116 may also be moved in the first direction Q1 and may thus lock the lid assembly 30 and the top cover 20. In this case, the lock element 112 may be referred to as being located at a lock position. When the lock element 112 is located at the lock position, the common contact U and the lock contact SW2 may be electrically connected by the lead 116, and the position detector 244_2 may transmit a detection signal S2 to the device controller 246.

That is, if the lock element 112 is moved to a lock position where it can lock the lid assembly 30 and the top cover 20, the lead 116 may be moved from its initial position to a position where the lower portion of the lead 116 can contact the lock contact SW2.

The device controller 246 may determine whether the motor 114 is broken based on the driving voltage detected by the voltage detector 244_1, and may determine whether the lid assembly 30 and the top cover 20 are locked or unlocked and whether laundry is stuck between the lid assembly 30 and the top cover 20 based on the initial detection signal S1 and the detection signal S2 provided by the position detector 244_2.

The device controller 246 may compare the driving voltage detected by the voltage detector 244_1 with a reference voltage. Then, if the driving voltage detected by the voltage detector 244_1 is higher than or the same as the reference voltage, the device controller 246 may determine that the motor 114 operates normally. On the other hand, if the driving voltage detected by the voltage detector 244_1 is lower than the reference voltage, the device controller 246 may determine that the motor 114 is broken.

If the motor 114 is determined to be broken, the device controller 180 may control both the first and second switches SH1 and SH2 of the device driver 242 to be switched off.

The device controller 246 may determine whether the lid assembly 30 and the top cover 20 are locked or unlocked based on the initial sensing signal and the detection signal S2.

If the detection signal S2 is not received even when the motor 114 operates normally or if the initial detection signal S1 is received, the device controller 246 may control the first and second switches SH1 and SH2 to be switched off so as to stop the motor 114 from rotating.

The device controller 246 may apply the first and second control signals SC_1 and SC_2 to the motor 114 so as to rotate the motor 114 in the first or second rotation Q1_1 or Q2_1, and may switch on the first and second switches SH1 and SH2 so as to form first and second paths I_1 and I_2.

In this exemplary embodiment, the device controller 246 may serve the same functions as the control unit 230 shown in FIG. 4.

Figure 8:
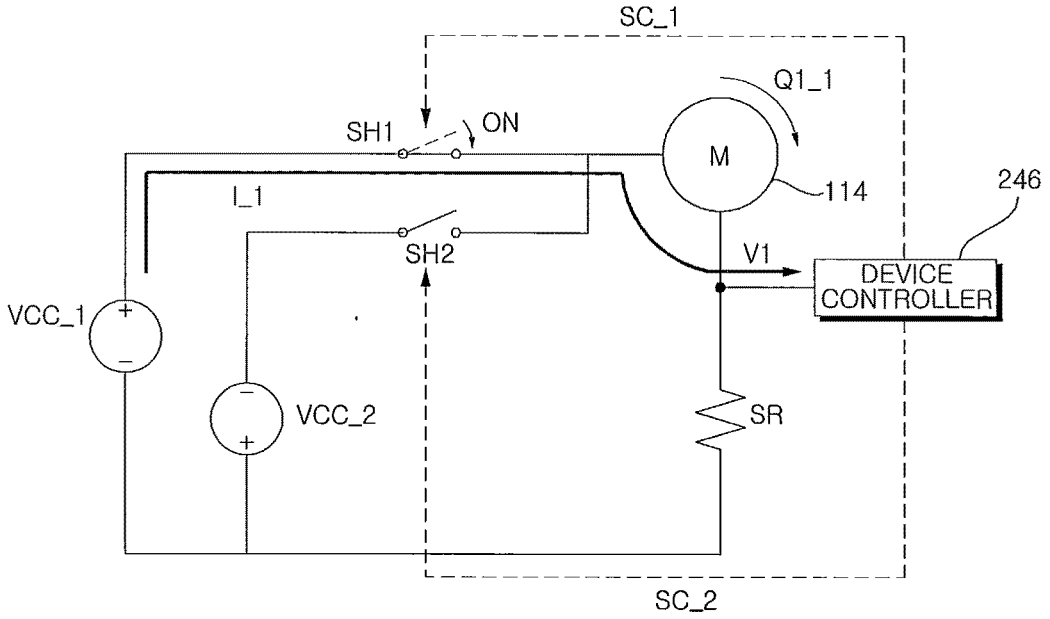
FIG. 8 illustrates a current path diagram for explaining a first path formed when a motor shown in FIG. 7 rotates in a first rotation direction.
Figure 9:
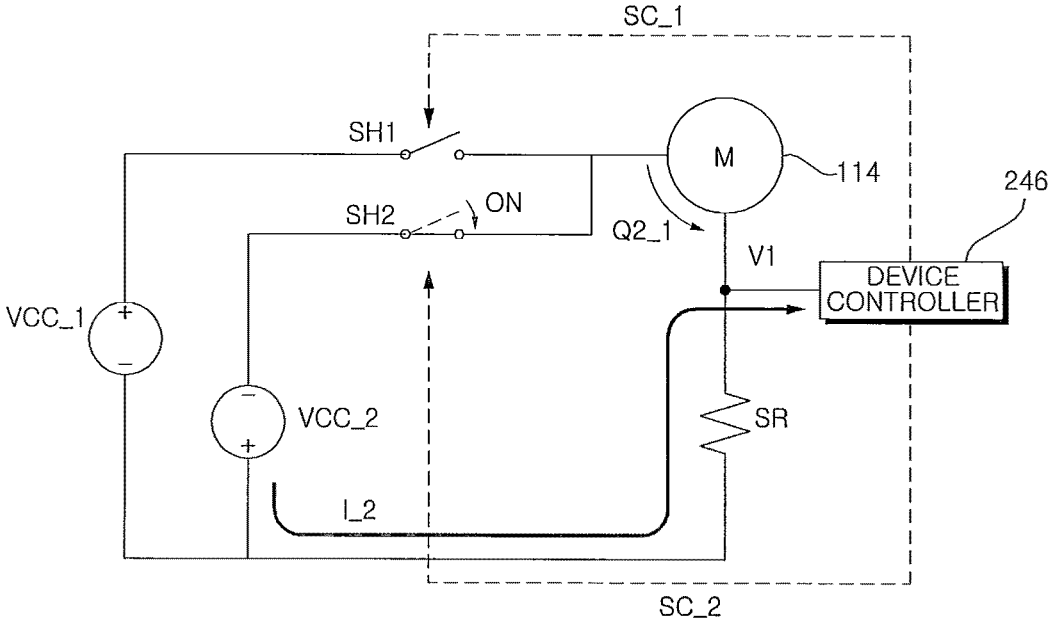
FIG. 9 illustrates a current path diagram for explaining a second path formed when the motor shown in FIG. 7 rotates in a second rotation.

FIG. 8 illustrates a current path diagram for explaining a first path I_1 that may be formed when the motor 114 shown in FIG. 6 rotates in the first rotation direction Q1_1, and FIG. 9 illustrates a current path diagram for explaining the second path I_2 that may be formed when the motor 114 shown in FIG. 6 rotates in the second rotation direction Q2_1. Referring to FIGS. 8 and 9, the device controller 246 may rotate the motor 114 in the first rotation direction Q1_1 and may thus form the first path I_1 so as to move the lock element 112 in the first direction Q1.

That is, the first path I_1 may be formed by applying the first control signal SC_1 to the first switch SH1 so as to switch on the first switch SH1 and supplying the first driving voltage V1 provided by the first power source VCC_1 to the motor 114.

In this case, the second switch SH2 may be switched off in response to the second control signal SC_2, and thus, the second path I_2 may not be formed.

When the first path I_1 is formed, the lock element 112 may be moved in the first direction Q1 and may thus lock the lid assembly 30 and the top cover 20.

The device controller 246 may apply the first and second control signals SC_1 and SC_2 according to whether the lid assembly 30 and the top cover 20 are placed in contact with each other. The device controller 246 may determine whether the lid assembly 30 and the top cover 20 contact each other based on whether magnets respectively attached to the lid assembly 30 and the top cover 20 contact each other.

The device controller 246 may rotate the motor 114 in the second rotation direction Q2_1 and may thus form the second path I_2 so as to move the lock element 112 in the second direction Q2.

That is, the second path I_2 may be formed by applying the second control signal SC_2 to the second switch SH2 so as to switch on the first switch SH1 and supplying the second driving voltage V2 provided by the second power source VCC_2 to the motor 114.

In this case, the first switch SH1 may be switched off in response to the first control signal SC_1, and thus, the first path I_1 may not be formed.

When the second path I_2 is formed, the lock element 112 may be moved in the second direction Q2 and may thus unlock the lid assembly 30 and the top cover 20.

The device controller 246 may receive one of the first and second driving voltages V1 and V2 detected by the voltage detector 244_1. Thereafter, if the received driving voltage is higher than or the same as the reference voltage, the device controller 246 may determine that the motor 114 operates normally. On the other hand, if the received driving voltage is lower than the reference voltage, the device controller 246 may determine that the motor 114 malfunctions.

The device controller 246 may alert a user to the operating state of the motor 114 by using the display unit 210 or the audio output unit 280 shown in FIG. 4.

Figure 10:
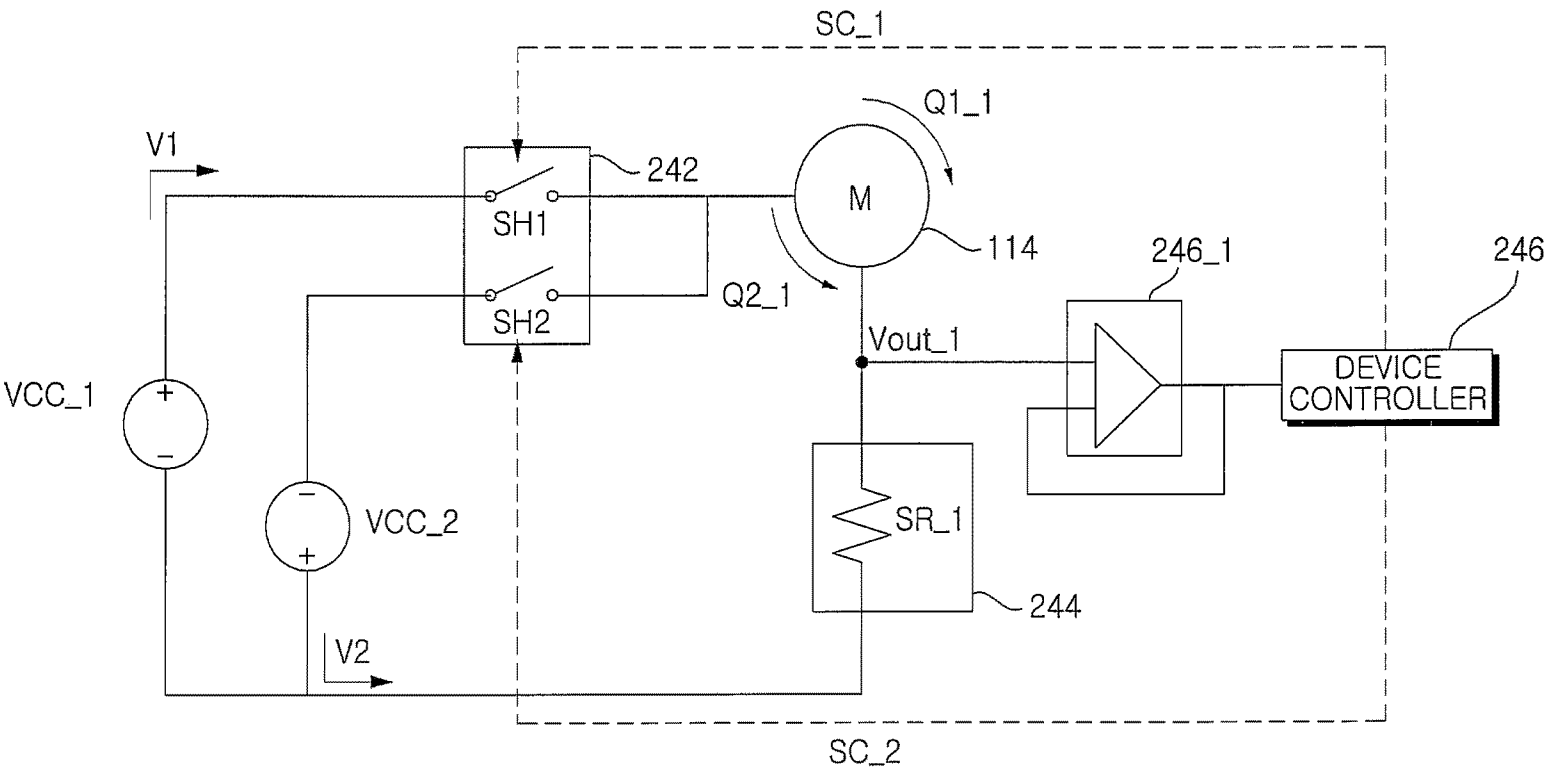
FIG. 10 illustrates a circuit diagram of a second embodiment of the device driving unit shown in FIG. 6.
Figure 11:
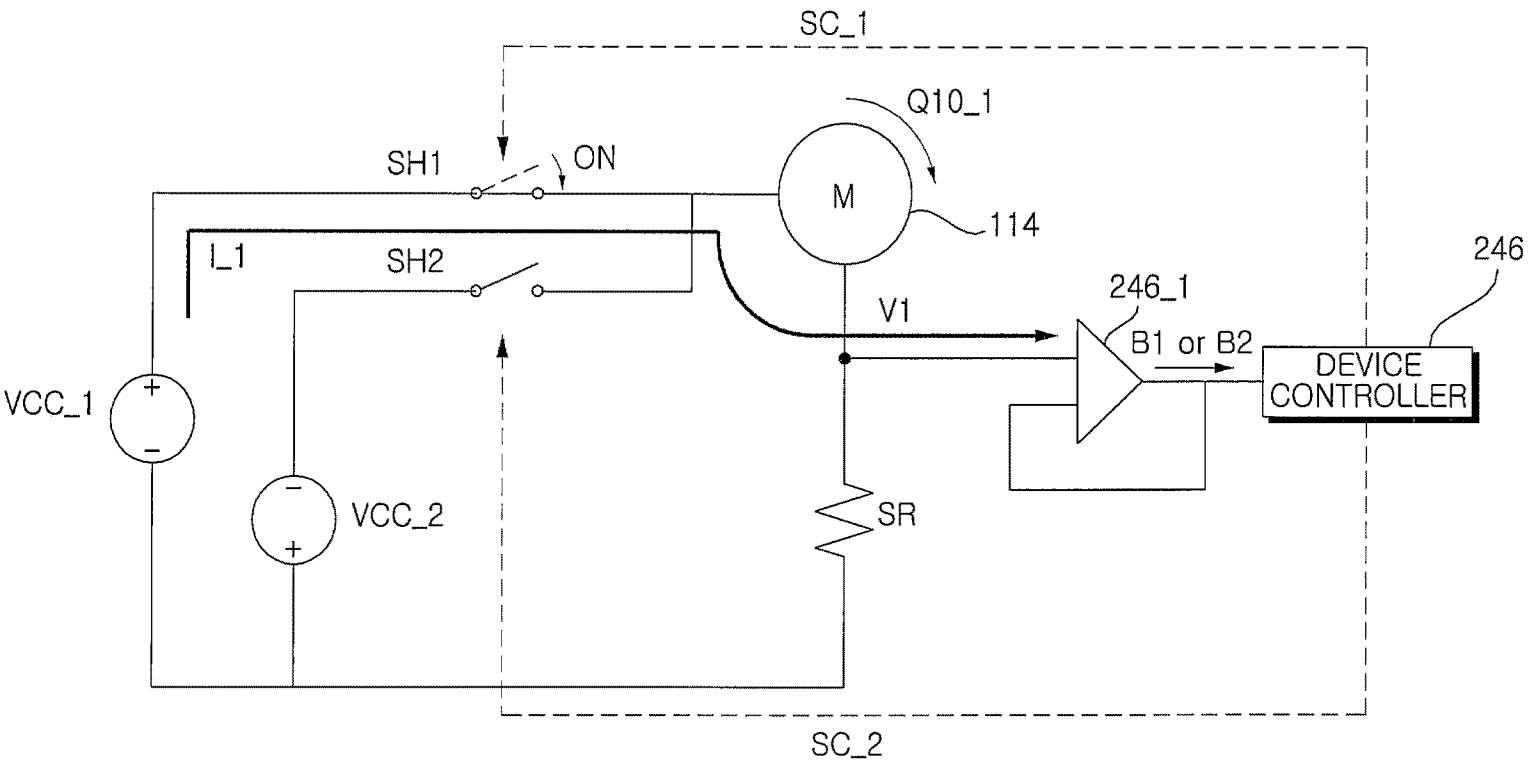
FIG. 11 illustrates a current path diagram for explaining a first path formed when a motor shown in FIG. 10 rotates in a first rotation direction.
Figure 12:
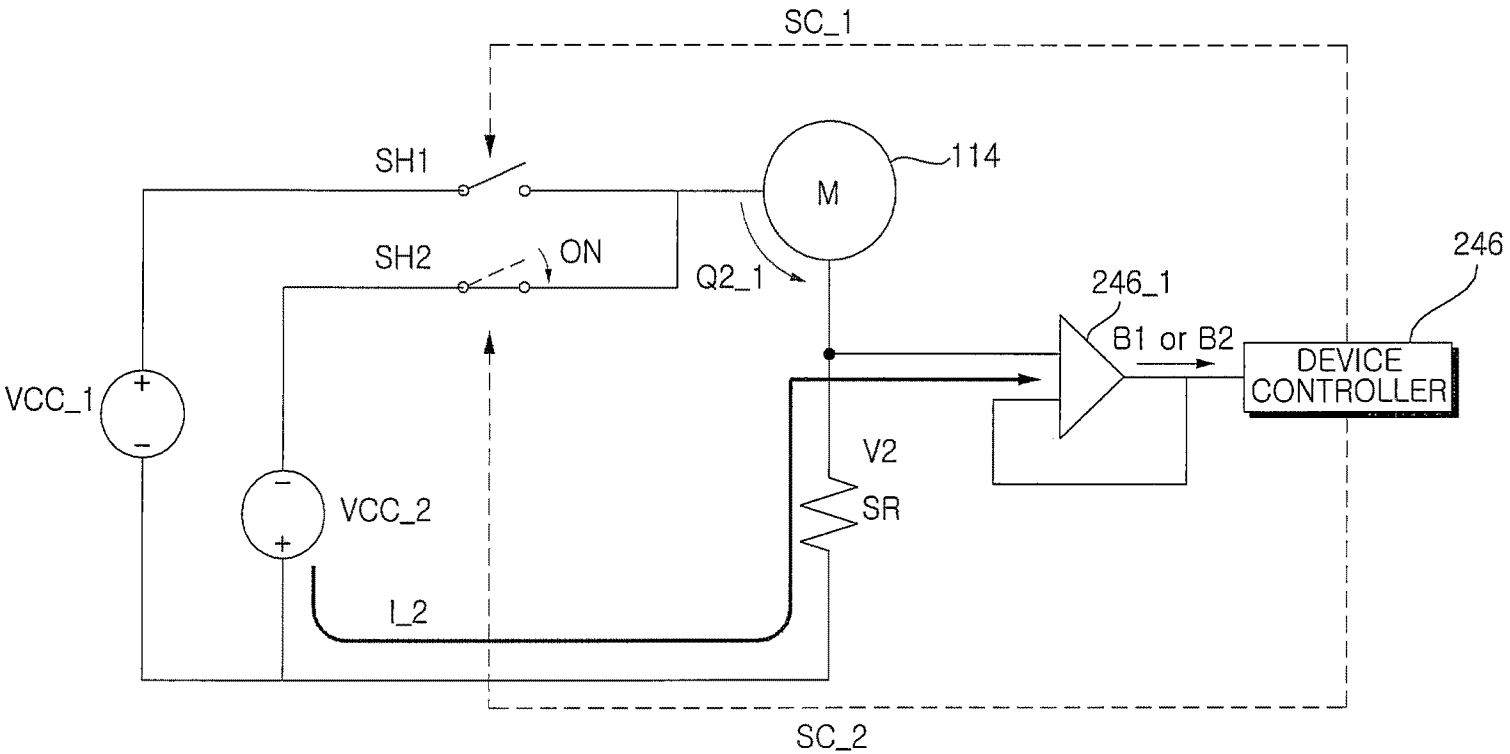
FIG. 12 illustrates a current path diagram for explaining a second path formed when the motor shown in FIG. 10 rotates in a second rotation.

FIG. 10 illustrates a circuit diagram of a second embodiment of the device driving unit 240 shown in FIG. 6, FIG. 11 illustrates a current path diagram for explaining a first path I_1 that may be formed when a motor 114 shown in FIG. 10 rotates in the first rotation direction Q1_1, and FIG. 12 illustrates a current path diagram for explaining a second path I_2 that may be formed when the motor 114 shown in FIG. 10 rotates in the second rotation direction Q2_1.

The exemplary embodiment of FIGS. 10 through 12 is similar to the exemplary embodiment of FIGS. 6 through 9, and thus will hereinafter be described, focusing mainly on differences with the exemplary embodiment of FIGS. 6 through 9.

Referring to FIG. 10, the device driving unit 240 may supply the first and second driving voltages V1 and V2 to or detect the first and second driving voltages V1 and V2 from the motor 114.

The device driving unit 240 may include a motor driver 242, which rotates the motor 114 in the first or second rotation Q1_1 or Q2_1, a voltage detector 244_1, which detects one of the first and second driving voltages V1 and V2 that are supplied to the motor 114, and a device controller 246, which determines whether the motor 114 is broken based on the driving voltage detected by the voltage detector 244_1 and controls the motor driver 242 based on the results of the determination.

The motor driver 242 and the voltage detector 244_1 are the same as their respective counterparts of FIGS. 6 and 7, and thus, detailed descriptions thereof will be omitted.

The device driving unit 240 may also include a comparer 246_1, which is connected between a shunt resistor SR of the voltage detector 244_1 and the device controller 246 and compares the driving voltage detected by the voltage detector 244_1 with a reference voltage.

More specifically, if the driving voltage detected by the voltage detector 244_1 is higher than or the same as the reference voltage, the comparer 246_1 may output a first comparison signal B1 to the device controller 246. On the other hand, if the driving voltage detected by the voltage detector 244_1 is lower than the reference voltage, the comparer 246_1 may output a second comparison signal B2 to the device controller 246.

The comparer 246_1 may be an operational amplifier and may be used as a voltage flower.

The device controller 246 may apply first and second control signals SC_1 and SC_2 to the motor 114 so as to rotate the motor 114 in the first or second rotation direction Q1_1 or Q2_1, and may switch on the first and second switches SH1 and SH2 so as to form first and second paths I_1 and I_2.

The device controller 246 may control the motor driver 242 to rotate the motor 114 in the first or second rotation direction Q1_1 or Q2_1 in response to the first or second comparison signal B1 or B2 provided by the comparer 246_1.

Referring to FIG. 11, the device controller 246 may rotate the motor 114 in the first rotation direction Q1_1 and may thus form the first path I_1 so as to move the lock element 112 in the first direction Q1.

The first path I_1 may be formed by applying the first control signal SC_1 to the first switch SH1 so as to switch on the first switch SH1 and supplying the first driving voltage V1 provided by the first power source VCC_1 to the motor 114.

In this case, the second switch SH2 may be switched off in response to the second control signal SC_2, and thus, the second path I_2 may not be formed.

When the first path I_1 is formed, the lock element 112 may be moved in the first direction Q1 and may thus lock the lid assembly 30 and the top cover 20.

The comparer 246_1 may compare the first driving voltage V1 detected by the voltage detector 244_1 with the reference voltage and may transmit one of the first and second comparison signals B1 and B2 to the device controller 246 based on the results of the comparison.

Then, the device controller 246 may determine whether the motor 114 operates normally or malfunctions based on the comparison signal provided by the comparer 246_1.

The device controller 246 may apply the first and second control signals SC_1 and SC_2 according to whether the lid assembly 30 and the top cover 20 are placed in contact with each other. The device controller 246 may determine whether the lid assembly 30 and the top cover 20 contact each other based on whether the magnets of the lid assembly 30 and the top cover 20 contact each other.

Referring to FIG. 12, the device controller 246 may rotate the motor 114 in the second rotation direction Q2_1 and may thus form the second path I_2 so as to move the lock element 112 in the second direction Q2.

That is, the second path I_2 may be formed by applying the second control signal SC_2 to the second switch SH2 so as to switch on the first switch SH1 and supplying the second driving voltage V2 provided by the second power source VCC_2 to the motor 114.

In this case, the first switch SH1 may be switched off in response to the first control signal SC_1, and thus, the first path I_1 may not be formed.

When the second path I_2 is formed, the lock element 112 may be moved in the second direction Q2 and may thus unlock the lid assembly 30 and the top cover 20.

The comparer 246_1 may compare the second driving voltage V2 detected by the voltage detector 244_1 with the reference voltage and may transmit one of the first and second comparison signals B1 and B2 to the device controller 246 based on the results of the comparison.

The device controller 246 may determine whether the motor 114 operates normally or malfunctions based on the comparison signal provided by the comparer 246_1.

More specifically, the device controller 246 may receive one of the first and second driving voltages V1 and V2 detected by the voltage detector 244_1. Thereafter, if the received driving voltage is higher than or the same as the reference voltage, the device controller 246 may determine that the motor 114 operates normally. On the other hand, if the received driving voltage is lower than the reference voltage, the device controller 246 may determine that the motor 114 malfunctions.

The device controller 246 may alert a user to the operating state of the motor 114 by using the display unit 210 or the audio output unit 280 shown in FIG. 4.

Figure 13:
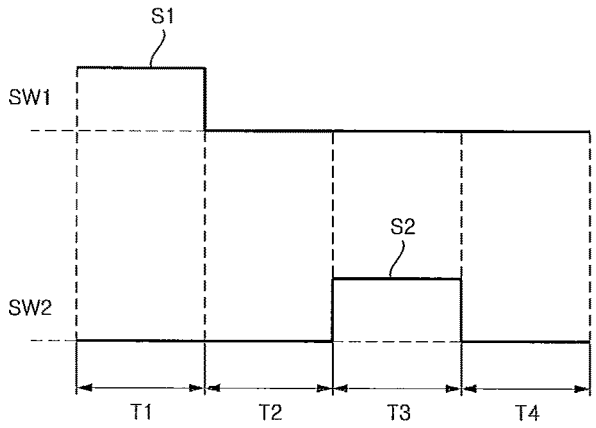
FIG. 13 illustrates a signal waveform diagram of signals for detecting the position of a lock element shown in FIG. 6.
Figure 14:
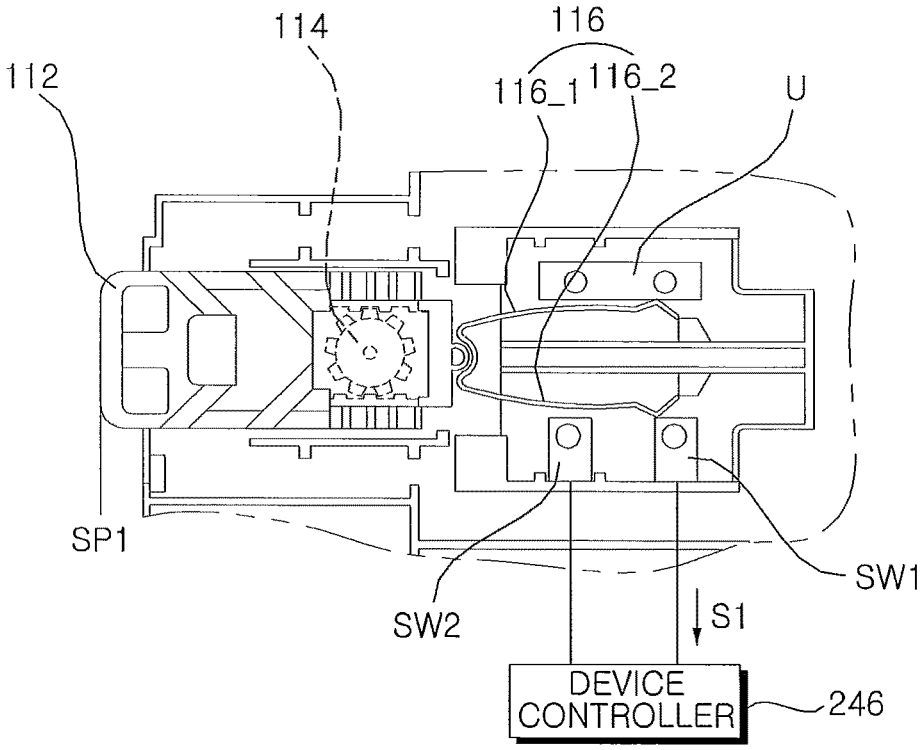
FIG. 14 illustrates a schematic diagram for explaining the operations of the lock device and the device driving unit during a first time period shown in FIG. 13.
Figure 15:
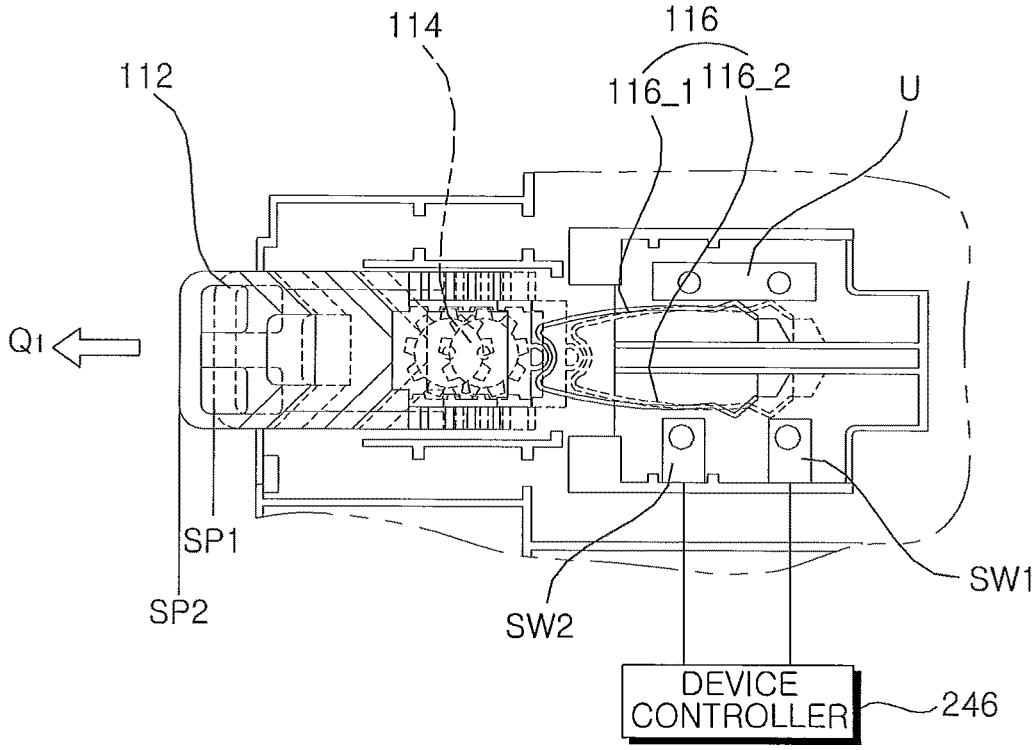
FIG. 15 illustrates a schematic diagram for explaining the operations of the lock device and the device driving unit during a second time period shown in FIG. 13.
Figure 16:
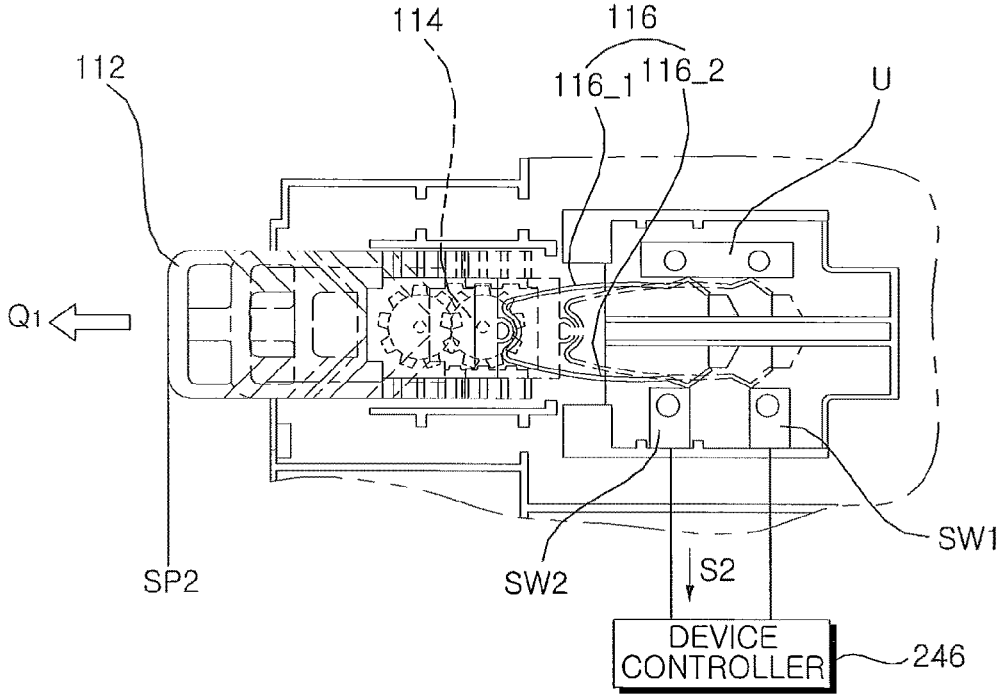
FIG. 16 illustrates a schematic diagram for explaining the operations of the lock device and the device driving unit during a third time period shown in FIG. 13.
Figure 17:
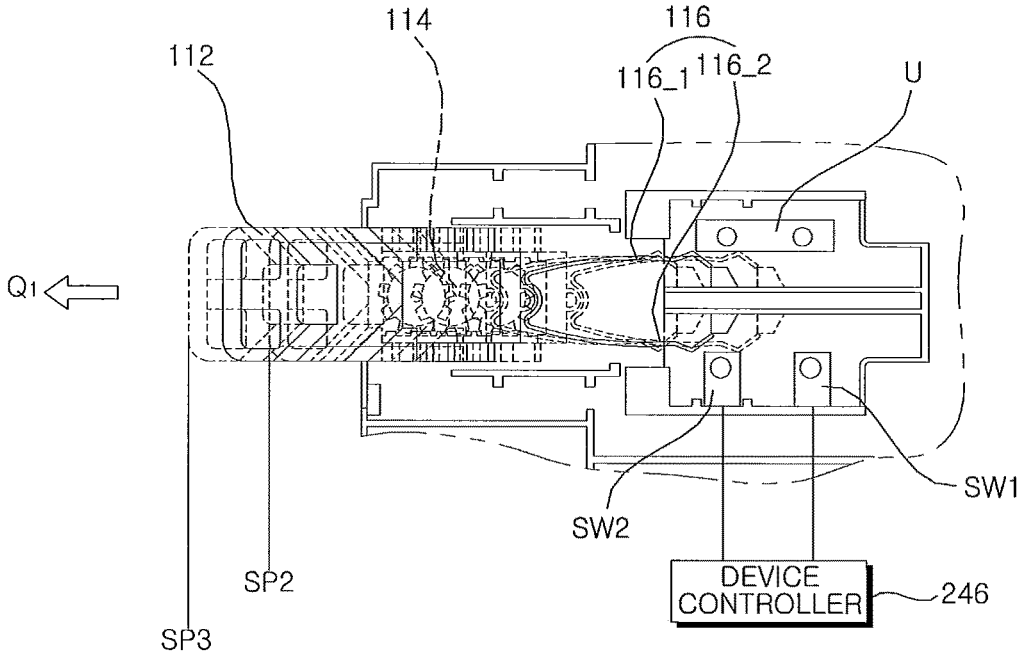
FIG. 17 illustrates a schematic diagram for explaining the operations of the lock device and the device driving unit during a fourth time period shown in FIG. 13.

FIG. 13 illustrates a signal waveform diagram of signals for detecting the position of the lock element 112, FIG. 14 illustrates a schematic diagram for explaining the operations of the lock device 110 and the device driving unit 240 during a first time period T1 shown in FIG. 13, FIG. 15 illustrates a schematic diagram for explaining the operations of the lock device 110 and the device driving unit 240 during a second time period T2 shown in FIG. 13, FIG. 16 illustrates a schematic diagram for explaining the operations of the lock device 110 and the device driving unit 240 during a third time period T3 shown in FIG. 13, and FIG. 17 illustrates a schematic diagram for explaining the operations of the lock device 110 and the device driving unit 240 during a fourth time period T4 shown in FIG. 13.

More specifically, FIG. 13 illustrates the waveforms of the initial detection signal S1 and the detection signal S2. Referring to FIG. 13, the initial detection signal S1 may be output when the common contact U and the initial contact SW1 are electrically connected by the lead 116, and the detection signal S2 may be output when the common contact U and the lock contact SW2 are electrically connected by the lead 116.

During the first time period T1, the lock element 112 may be maintained at an unlock position SP1, and the initial detection signal S1 may be output.

During the second time period T2, the lock element 112 may be moved from the unlock position SP1 to a lock position SP2, and none of the initial detection signal S1 and the detection signal S2 may be output.

During the third time period T3, the lock element 112 may be maintained at the lock position SP2, and the detection signal S2 may be output.

During the fourth period T4, the lock element 112 may be moved from the lock position SP2 to a maximum position SP3, and none of the initial detection signal S1 and the detection signal S2 may be output.

FIG. 14 illustrates the position of the lock element 112 during the first time period T1. Referring to FIG. 14, during the first time period T1, the lock element 112 may be located at its initial position, i.e., the unlock position SP1, and the lead 116, which moves along with the lock element 112, may be located at a position where it can electrically connect the common contact U and the initial contact SW1.

During the first time period T1, the device controller 246 of the device driving unit 240 may control the motor driver 242 not to rotate the motor 114 since the lid assembly 30 and the top cover 20 are yet to be coupled, and may receive the initial detection signal S1 from the position detector 244_2.

FIG. 15 illustrates the position of the lock element 112 during the second time period T2. Referring to FIG. 15, during the second time period T2, the lock element 112 may be located between the unlock position SP1 and the lock position SP2.

The device controller 246 may determine whether the lid assembly 30 and the top cover 20 are coupled based on whether the magnets of the lid assembly 30 and the top cover 20 are placed in contact with each other. If the lid assembly 30 and the top cover 20 are determined to be coupled, the device controller 246 may transmit the first control signal SC_1 to the motor driver 242.

Then, the motor driver 242 may rotate the motor 114 in the first rotation direction Q1_1 in response to the first control signal SC_1 and may thus move the lock element 112 in the first direction Q1.

In this case, since the lock element 112 is still in the middle of being moved to the lock position SP2, the device controller 246 may not be provided with the initial detection signal S1 and the detection signal S2 by the position detector 244_2.

Thereafter, if the detection signal S2 is not received within a first setting time of the receipt of the initial detection signal S1, the device controller 246 may stop the rotation of the motor 114, and may determine that laundry is stuck between the lid assembly 30 and the top cover 20. Therefore, the device controller 246 may generate lock error information and may thus output the lock error information to a user.

That is, during the second time period T2, the upper portion 116_1 of the lead 116 contacts the common contact U, but the lower portion 116_2 of the lead 116 does not contact any one of the initial contact SW1 and the lock contact SW2. If this condition continues for more than the first setting time, the device controller 246 may control the motor driver 242 to stop rotating the motor 114.

FIG. 16 illustrates the position of the lock element 112 during the third time period T3. Referring to FIG. 16, during the third time period T3, the lock element 112 may be located at the lock position SP2.

When the lock element 112 is moved in the first direction Q1 and thus reaches the lock position SP2, the device controller 246 may receive the detection signal S2 from the position detector 244_2 because the upper and lower portions 116_1 and 116_2 of the lead 116 are placed in contact with the common contact U and the lock contact SW2, respectively.

In this case, the device controller 246 may determine that the lid assembly 30 and the top cover 20 are locked by the lock element 112.

FIG. 17 illustrates the position of the lock element 112 during the fourth time period T4. Referring to FIG. 17, during the fourth time period T4, the lock element 112 may be moved past the lock position SP2 and may thus reach the maximum position SP3.

In this case, if no other detection signal S2 is received within a second setting time of the receipt of the detection signal S2 during the third time period T3, the device controller 246 may determine that the lock element 112 is located at the maximum position SP3, and that the lid assembly 30 and the top cover 20 are detached from each other. Therefore, the device controller 246 may generate detachment information indicating that the lid assembly 30 and the top cover 20 are no longer coupled, and may output the detachment information to a user.

The detachment information may also indicate whether laundry is stuck between the lid assembly 30 and the top cover 20 and whether the lid assembly 30 and the top cover 20 are opened.

During the fourth time period T4, the upper portion 116_1 of the lead 116 contacts the common contact U, but the lower portion 116_2 of the lead 116 does not contact any one of the initial contact SW1 and the lock contact SW2.

When the lock element 112 is located at the maximum position SP3, the device controller 246 may control the motor driver 242 to rotate the motor 114 in the second rotation direction Q2_1 and may thus move the lock element 112 in the second direction Q2.

Figure 18:
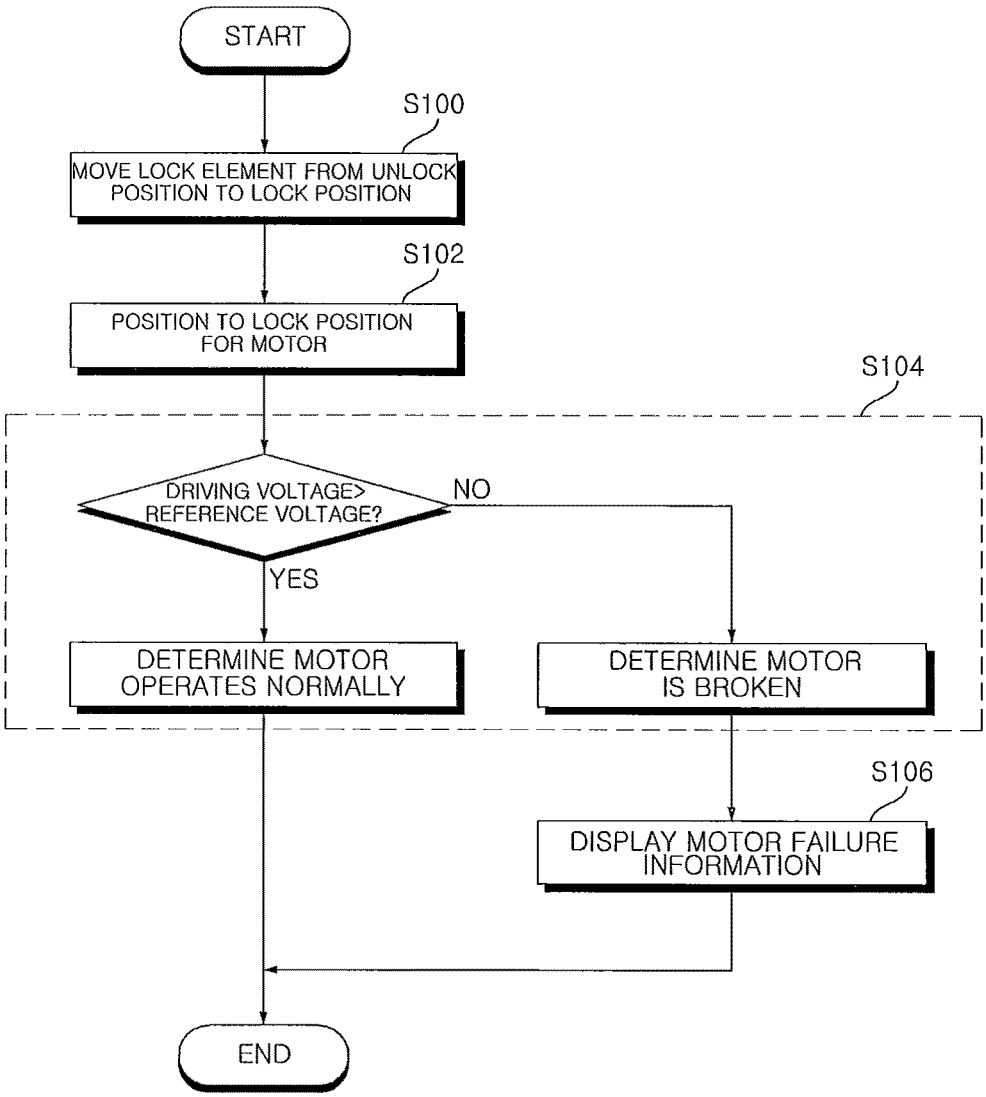
FIG. 18 illustrates a flowchart of a control method of a laundry treatment machine, according to a first exemplary embodiment of the present invention.

FIG. 18 illustrates a flowchart of a control method of a laundry treatment machine, according to a first exemplary embodiment of the present invention, and particularly, how to determine whether the motor 114 is broken. Referring to FIG. 18, when the lid assembly 30 and the top cover 20 are coupled, the motor 114 may be rotated in the first rotation direction Q1_1 in response to an input command so as to move the lock element 112 from the unlock position SP1 to the lock position SP2 (S100). More specifically, the device controller 246 may determine whether the lid assembly 30 and the top cover 20 are coupled. If the lid assembly 30 and the top cover 20 are determined to be coupled, the device controller 246 may transmit the first control signal SC_1 to the motor driver 242 and may thus control the motor driver 242 to rotate the motor 114 in the first rotation direction Q1_1 in order to move the lock element 112 from the unlock position SP1 to the lock position SP2.

Thereafter, if the motor 114 rotates in the first rotation direction Q1_1, a driving voltage supplied to the motor 114 may be detected (S102). Thereafter, the detected driving voltage may be compared with a reference voltage, and it may be determined whether the motor 114 is broken based on the results of the comparison (S104). More specifically, when the motor 114 rotates in the first rotation direction Q1_1, the voltage detector 244_1 may detect the first driving voltage V1 from the motor 114. Then, the device controller 246 may compare the first driving voltage V1 with the reference voltage. Thereafter, if the first driving voltage V1 is lower than the reference voltage, the device controller 246 may determine that the motor 114 is broken. On the other hand, if the first driving voltage V1 is higher than or the same as the reference voltage, the device controller 246 may determine that the motor 114 operates normally.

Thereafter, if the motor 114 is determined to be broken, failure information may be output in order to alert a user (S106).

Figure 19:
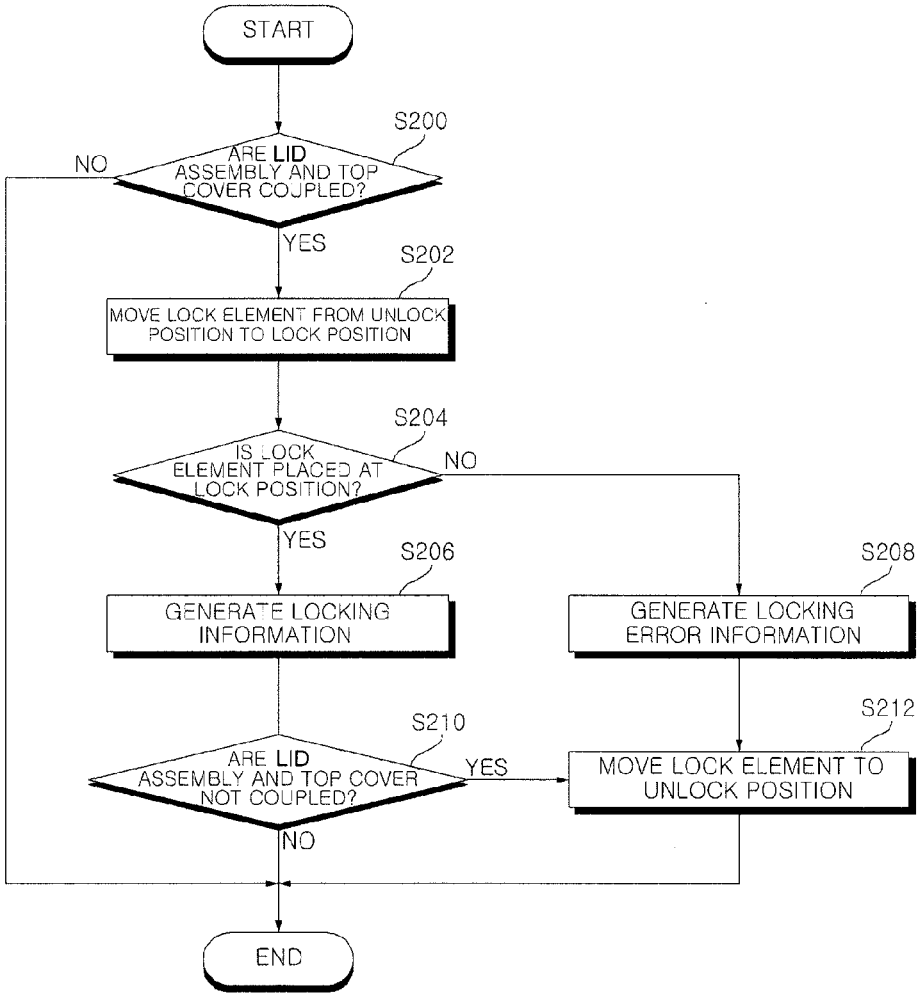
FIG. 19 illustrates a flowchart of a control method of a laundry treatment machine, according to a second exemplary embodiment of the present invention.

FIG. 19 illustrates a flowchart of a control method of a laundry treatment machine, according to a second exemplary embodiment of the present invention, and particularly, how to determine whether the lid assembly 30 and the top cover 20 are locked or unlocked and whether laundry is stuck between the lid assembly 30 and the top cover 20 based on the position of the lock element 112. Referring to FIG. 19, it may be determined whether the lid assembly 30 and the top cover 20 are coupled (S200). More specifically, the device controller 246 may determine whether the lid assembly 30 and the top cover 20 are coupled by determining whether the magnets of the lid assembly 30 and the top cover 20 are placed in contact with each other.

When the lid assembly 30 and the top cover 20 are coupled, the device controller 246 can detect voltage variations caused by variations in the magnetic fields of the magnets of the lid assembly 30 and the top cover 20.

Thereafter, the lock element 112 may be moved from the unlock position SP1 to the lock position SP2 in response to an input command (S202). More specifically, the device controller 246 may control the motor driver 242 to rotate the motor 114 in the first rotation direction Q1_1 and may thus move the lock element 112 in the first direction Q1. As a result, the lock element 112 can be moved in the first direction Q1 from the unlock position SP1 to the lock position SP2.

Thereafter, it may be determined whether the lock element 112 is located at the lock position SP2 (S204). More specifically, the device controller 246 may determine whether the lock element 112 has been moved from the unlock position SP1 to the lock position SP2. The position detector 244_2 may detect the positions of the upper and lower portions 116_1 and 116_2 of the lead 116, which moves along with the lock element 112. Since the distance by which the lock element 112 moves is the same as the distance by which the lead 116 moves, the position detector 244_2 can determine the position of the lock element 112 based on the position of the lead 116.

When the lock element 112 is located at the unlock position SP1, the upper and lower portions 116_1 and 116_2 of the lead 116 may contact the common contact U and the initial contact SW1, respectively, and the position detector 244_2 may transmit the initial detection signal to the device controller 246 as the result of the detection of the position of the lock element 112.

Thereafter, if the lock element 112 is moved from the unlock position SP1 to the lock position SP2, the upper and lower portions 116_1 and 116_2 of the lead may be placed in contact with the common contact U and the lock contact SW2, respectively, and the position detector 244_2 may transmit the detection signal S2 to the device controller 246 as the result of the detection of the position of the lock element 112.

If it is determined in operation S204 that the lock element 112 is located at the lock position SP2, it may be determined that the lid assembly 30 and the top cover 20 are locked, and thus, lock information may be generated (S206). On the other hand, if it is determined in operation 5204 that the lock element 112 is not located at the lock position SP2, it may be determined that the lid assembly 30 and the top cover 20 are yet to be locked, and thus, lock error information may be generated (S208). More specifically, if the detection signal S2 is received from the position detector 244_2, the device controller 246 may determine that the lid assembly 30 and the top cover 20 are locked, and may thus generate and output the lock information in order to alert a user.

However, if the detection signal S2 is not received within a first setting time of the receipt of the initial detection signal S1, the device controller 246 may determine that laundry is stuck between the lid assembly 30 and the top cover 20, and may thus generate and output the lock error information in order to alert a user.

Thereafter, it may be determined whether the lid assembly 30 and the top cover 20 are detached from each other (S210). More specifically, the device controller 246 may determine whether the lock element 112 has been moved past the lock position SP2 and is located at the maximum position SP3.

If the lock element 112 is moved past the lock position SP2, the lower portion 116_2 of the lead 116 may not contact the lock contact SW2 any longer, and thus, the detection signal S2 may not be detected any longer.

Therefore, if no other detection signal S2 is received within a second setting time of the receipt of the detection signal S2 in operation 5204, the device controller 246 may determine that the lid assembly 30 and the top cover 20 are no longer coupled, and may thus generate and output detachment information in order to alert a user.

Once the lock error information or the detachment information is generated because of laundry stuck between the lid assembly 30 and the top cover 20 or the detachment of the lid assembly 30 and the top cover 20 from each other, the device controller 246 may rotate the motor 112 in the second rotation direction Q2_1 and may thus move the lock element 112 back to the unlock position SP1.

As described above, according to the present invention, it is possible to easily determine whether a motor, which is provided for moving a lock element that locks or unlocks a lid assembly and a top cover, is broken by detecting a driving voltage supplied to the motor.

In addition, according to the present invention, it is possible to easily determine whether the lid assembly and the top cover are locked or unlocked and whether laundry is stuck between the lid assembly and the top cover by detecting the position of the lock element.

Moreover, according to the present invention, it is possible to easily determine whether the lid assembly and the top cover are coupled.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A laundry treatment machine comprising:

a top cover configured to have a laundry entrance hole through which laundry is put in or taken out of the laundry treatment machine;

a lid assembly configured to be disposed above the top cover so as to be rotatable, the lid assembly opening or shutting the laundry entrance hole;

a lock device configured to include a lock element and a lead, the lock element locking or unlocking the lid assembly and the top cover, and the lead moving in the same direction as the lock element; and a device driving unit configured to detect a position of the lead, determine an operating state of the lock device based on the detected position of the lead, and control an operation of the lock device, wherein the device driving unit includes a device controller which, if the lock element is moved from its initial unlock position to a lock position where it can lock the lid assembly and the top cover, receives an initial detection signal, and if a first detection signal is not received within a first setting time of the receipt of the initial detection signal, the device controller determines that the lid assembly and the top cover are not properly locked, and outputs first error information, wherein the device controller controls the lock device for the lock element to move from the lock position to a maximum position after the receipt of the first detection signal, wherein even if the first detection signal is received within the first setting time of the receipt of the initial detection signal, the device controller outputs second error information if no other detection signal is received within a second setting time of the receipt of the first detection signal, wherein the lock device includes a common contact which is contacted by an upper portion of the lead, an initial contact which is contacted by a lower portion of the lead when the lead is located at its initial position, and a second lock contact which is contacted by the lower portion of the lead when the lead is located at the lock position, wherein the device driving unit further comprises a position detector, which outputs the initial detection signal if the upper and lower portions of the lead contact the common contact and the initial contact, respectively, and outputs the first detection signal if the upper and lower portions of the lead contact the common contact and the second lock contact, respectively, wherein the position detector if the lock element is moved from its initial unlock position to the lock position where it can lock the lid assembly and the top cover, determines whether the lead is moved from its initial position to the lock position and outputs the first detection signal as the result of the determination, wherein the device controller determines that the lid assembly and the top cover are not locked and outputs the first error information if the first detection signal is not received from the position detector, and wherein the device controller if no other detection signal is received within the second setting time of the receipt of the first detection signal, determines that the lid assembly and the top cover are detached from each other and outputs the second error information including detachment information.

2. The laundry treatment machine of claim 1, wherein the first error information includes information indicating that laundry is stuck between the lid assembly and the top cover.

3. The laundry treatment machine of claim 1, wherein the second error information includes information indicating that the lid assembly and the top cover are locked when not coupled.

4. The laundry treatment machine of claim 1, wherein, if the first detection signal is not received within the first setting time of the receipt of the initial detection signal, the device controller determines that laundry is stuck between the lid assembly and the top cover and outputs the lock error information.

5. The laundry treatment machine of claim 1, wherein, if magnets respectively attached to the lid assembly and the top cover contact each other, the device controller determines that the lid assembly and the top cover are coupled, and controls the lock element to be moved from the unlock position to the lock position.

6. The laundry treatment machine of claim 1, further comprising a display unit configured to display the lock information, the lock error information and the detachment information.

7. The laundry treatment machine of claim 1, wherein the lock device further includes a motor, which is rotated so as to move the lock element, and the device driving unit further includes a voltage detector, which detects a driving voltage supplied to the motor when the motor is rotated.

8. The laundry treatment machine of claim 7, wherein, if the driving voltage detected by the voltage detector is lower than a reference voltage, the device controller determines that the motor is broken and controls the motor driving unit accordingly.

9. The laundry treatment machine of claim 1, wherein, if the first detection signal is still received within the second setting time of the receipt of the first detection signal, the device controller determines that the lid assembly and the top cover are locked.

* * * * *